US006347208B1

(12) United States Patent
Yamamoto

(10) Patent No.: US 6,347,208 B1
(45) Date of Patent: Feb. 12, 2002

(54) DEVELOPING APPARATUS WITH DEVELOPER COLLECTION FEATURE

(75) Inventor: Takeshi Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/603,190

(22) Filed: Jun. 26, 2000

(30) Foreign Application Priority Data

Jun. 29, 1999 (JP) ..... 11-184307

(51) Int. Cl.[7] ..... G03G 15/08
(52) U.S. Cl. ..... 399/281; 399/283
(58) Field of Search ..... 399/53, 55, 281, 399/283, 285

(56) References Cited

U.S. PATENT DOCUMENTS 4,378,158 A * 3/1983 Kanbe ..... 399/281
4,481,903 A * 11/1984 Haberhauer et al. ..... 399/281
5,172,169 A * 12/1992 Takashima et al. ..... 399/281
5,570,164 A * 10/1996 Yamamoto et al. ..... 399/283
5,963,768 A * 10/1999 Rhee ..... 399/283
6,041,208 A * 3/2000 Choi ..... 399/281

* cited by examiner

*Primary Examiner*—William J. Royer
(74) *Attorney, Agent, or Firm*—Fitzpatrick, Cella, Harper & Scinto

(57) ABSTRACT

A developing apparatus includes a developer carrying member carrying a developer thereon. A developer supplying device supplies the developer to the developer carrying member. A developer collecting device collects any residual developer on the developer carrying member after having passed the developing portion. During a period when the developing operation is not being performed, the developer on the developer carrying member is collected by the developer collecting device with the supply of the developer by the developer supplying device being stopped.

16 Claims, 4 Drawing Sheets

DEVELOPING APPARATUS WITH DEVELOPER COLLECTION FEATURE

BACKGROUND OF THE INVENTION

1. Field of the Invention

This invention relates to a developing apparatus using a powder developer, and particularly to a developing apparatus applicable to the developing means of an image forming apparatus such as a printer, a facsimile apparatus or a copier utilizing the electrophotographic method or the electrostatic recording method to effect image formation.

2. Related Background Art

In an image forming apparatus utilizing the electrophotographic method, an electrostatic latent image is formed on a photosensitive body as an image bearing member, and the electrostatic latent image is developed by a toner to thereby form a toner image, which is then transferred onto a transferring material to thereby obtain an image.

As the above-described developing method, generally a monocomponent developing method using a monocomponent developer comprising only a toner that is simple in construction of a developing apparatus and is easy to maintain, as compared with a two-component developing method using a developer comprising magnetic particles and a toner and therefore, many developing apparatuses based on the monocomponent developing method have been proposed. Also, a developing method by a nonmagnetic monocomponent developing method not using a magnetic toner has been proposed, and this developing method is put into practical use to cope with the recent requirement for color images.

FIG. 7 of the accompanying drawings is a schematic cross-sectional view showing an example of the conventional developing apparatus using the nonmagnetic monocomponent developing method.

In this figure, the reference numeral 120 designates a rotatable developing roller as a developer carrying member, and it substantially abuts against a photosensitive drum 130 as an image bearing member in a developing portion. A toner supplying and collecting roller 121 as a developer supplying and collecting member and a regulating blade 122 as a developer regulating member abut against this developing roller 120.

The regulating blade 122 is comprised of a support member 122*a* formed of phosphor bronze or the like and an elastic member 122*b* of urethane rubber or the like adhesively secured to the fore end thereof, whereby it has the action of forming a thin layer of toner on the surface of the developing roller 120 and imparting charges to the toner.

The toner supplying and collecting roller 121 comprises a mandrel 121*a* of SUS or the like and an elastic member 121*b* of urethane foam or the like covering the outer peripheral surface thereof, whereby it has the action of supplying the toner (not shown) stored in a developing container 123 to the surface of the developing roller 120, and scraping off the toner returned without contributing to the developing step from the surface of the developing roller 120. The reference numeral 124 denotes a toner agitating member for agitating the toner.

By such a construction, a thin layer of nonmagnetic toner is formed on the developing roller 120, and an electrostatic latent image on the photosensitive drum 130 can be developed to thereby obtain a toner image.

Now, in the above-described conventional non-magnetic monocomponent developing method, the toner supplying and collecting roller 121 abuts against the developing roller 120 and rotates and frictionally slides to thereby effect the supply and collection of the toner. Also, the imparting of charges to the toner is effected chiefly by the contact friction when the toner passes the regulating blade 122.

That is, during the time until the toner in the developing container 123 is developed on the photosensitive drum 130, a mechanical load (stress) applied to the toner is very great, and the damage of the toner is very great as compared with that in the other developing methods.

Also, in this non-magnetic monocomponent developing method, not only is the load applied to the toner great, but also a load applied to a developing device itself is great. Furthermore, in the case of the above-described toner supplying and collecting roller 121 using a sponge roller if frictional sliding relative to the developing roller 120 continues for a long time, there is wear and damage of the toner supplying and collecting roller 121. In addition, clogging or the like of the toner occur. Consequently, the performance of the toner supplying and collecting roller 121 becomes insufficient, and good toner supply may become impossible.

Further, when a great deal of image formation has been effected, the toner which has not contributed to development cannot be collected by the toner supplying and collecting roller 121 and is accumulated little by little on the developing roller 120, and in some cases, such toner might be fused on the developing roller 120 and the regulating blade 122 to thereby cause bad image formation.

SUMMARY OF THE INVENTION

It is an object of the present invention to provide a developing apparatus which can stably form good images.

It is also an object of the present invention to provide a developing apparatus which enables any toner residual on a developing roller to be effectively collected and can effect good image formation.

It is also an object of the present invention to provide a developing apparatus comprising:

- a developing carrying member carrying a developer thereon, the developer carrying member carrying the developer carried thereon to a developing portion, and developing a latent image formed on an image bearing member by the developer in the developing portion;
- developer supplying means for supplying the developer to the developer carrying member, the developer supplying means being provided in non-contact with the developer carrying member; and
- developer collecting means for collecting any developer residual on the developer carrying member after having passed the developing portion;
- wherein during a period when the developing operation is not being performed, the developer on the developer carrying member is collected by the developer collecting means with the supply of the developer by the developer supplying means being stopped.

Other objects and features of the present invention will become more fully apparent from the following detailed description when read with reference to the accompanying drawings.

DESCRIPTION OF THE PREFERRED EMBODIMENT

Figure 1:
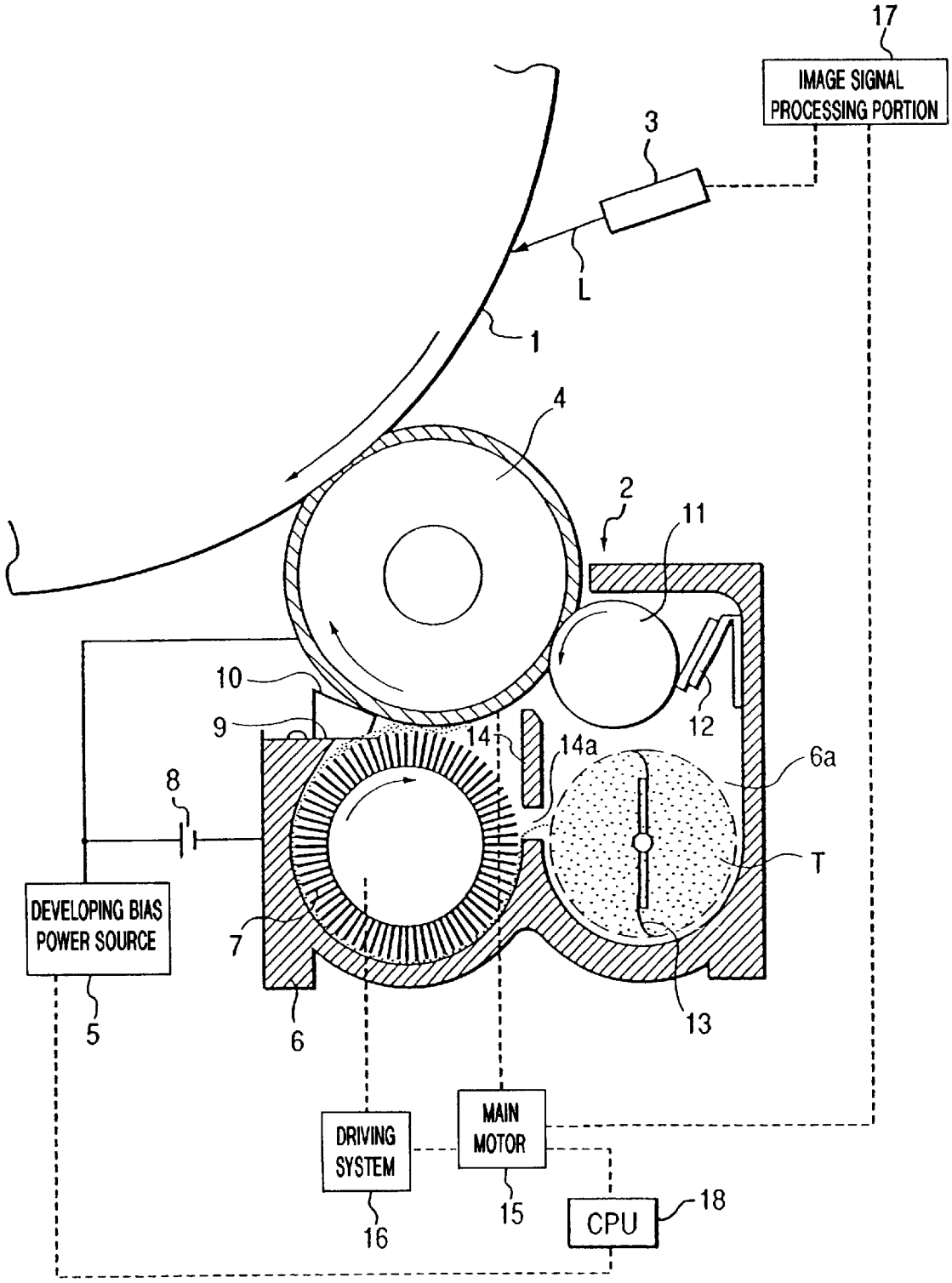
FIG. 1 is a schematic cross-sectional view showing a developing apparatus according to an embodiment of the present invention.

The present invention will hereinafter be described with respect to an embodiment thereof shown in the drawings.

FIG. 1 is a schematic cross-sectional view showing a developing apparatus according to the embodiment of the present invention.

This developing apparatus 2 has a developing roller 4 of which the surface contacting with the surface of a photosensitive drum 1 as an image bearing member has elasticity, and is rotated in the direction of arrow (clockwise direction). The present embodiment uses a contact developing method of bringing the developing roller 4 into contact with the photosensitive drum 1 and causing a toner to adhere to an electrostatic latent image on the surface of the photosensitive drum 1 to thereby form a toner image, but of course, when the electrostatic latent image is to be toner-developed by a noncontact developing method, a developing roller of a rigid material formed of a metal such as SUS or aluminum may be used without any problem.

Figure 2:
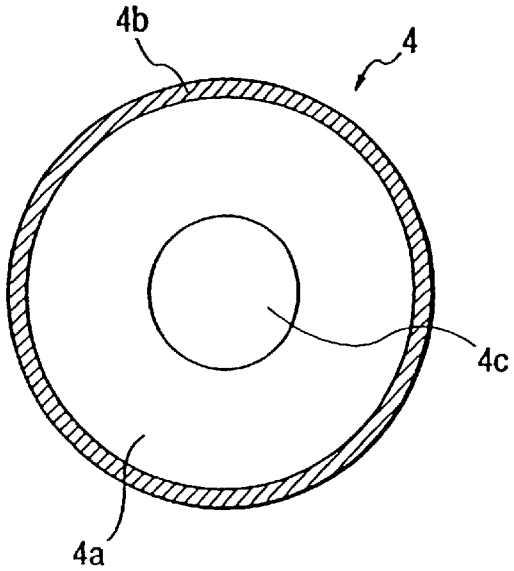
FIG. 2 is a cross-sectional view of a developing roller.

The developing roller 4, as shown in FIG. 2, has an elastic layer 4*a* on the surface of a metallic mandrel 4*c*. As the material of the elastic layer 4*a*, use can be made of an ordinary rubber material such as silicone rubber, NBR rubber, EPDM rubber or urethane rubber, and in the present embodiment, silicone rubber is used. The construction of the elastic layer 4*a* may be of single layer structure, but in the present embodiment, with the charge imparting property to the toner taken into account, the surface of the elastic layer 4*a* is covered with electrically conductive resin film 4*b* comprising carbon or the like dispersed in resin such as nylon.

The rubber hardness of the elastic layer 4*a*, including the electrically conductive resin film 4*b*, is measured by JIS-A rubber hardness meter, and the hardness thereof is suitably 20 to 70 degrees, and if the hardness exceeds 70 degrees, the area of contact thereof with the photosensitive drum 1 will become small and it will become difficult to effect sufficient development. Likewise, if the rubber hardness is high, a fluctuation in the amount of entry will occur when the developing roller 4 is made to abut against the photosensitive drum 1, and may greatly vary the abutting force therebetween, and this is not preferable in construction.

On the other hand, if the rubber hardness is too low (equal to or less than 20 degrees), the compressing permanent distortion of the rubber will become great and the elasticity of the rubber will be lost by being left as it is, and the rubber will become liable to be deformed. Also, the surface of the elastic layer 4*a* may desirably be 3 to 20 in Rz value which is the surface roughness thereof with the carrying property for the toner taken into account, and is set in accordance with the particle diameter and shape of the toner used.

In the present embodiment, the thin electrically conductive resin film 4*b* is provided on the surface of the elastic layer 4*a*, but this film is very thin and therefore, the surface roughness set for the elastic layer 4*a* is intactly reflected in the surface. Further, as regards the resistance of the developing roller 4, the resistance value thereof may preferably be as low as possible so that counter charges produced during the contact friction charging with the toner may not be residual on the surface of the developing roller 4, but if a pinhole should be present in the surface of the photosensitive drum 1, leak may be caused in the nip portion with the photosensitive drum 1 during development. Consequently, the resistance value of the developing roller 4 may desirably be set so as to volume resistance of the order of $10^3$ to $10^9$ Ω·cm in a state including the electrically conductive resin film 4*b*.

The structure of the developing roller 4 is not restricted to the above-described construction, but may be, for example, an elastic developing roller of a laminated type having the construction of a plurality of elastic layers, and can be chosen in conformity with the toner used and the conditions of image formation.

A developing bias power source 5 is connected to the mandrel 4*c* of the developing roller 4, and a predetermined developing bias is applied to the mandrel 4*c*. For example, in the case of the contact developing method using the developing roller 4, a developing bias of only DC may be applied with the leak or the like with the photosensitive drum 1 taken into account, and when the developing roller 4 or a metallic rigid roller is used as a developing roller and toner image formation is effected in non-contact with the photosensitive drum 1, a developing bias comprising DC superimposed AC may be applied. In the present embodiment, a developing bias of only DC is applied from the developing bias power source 5 to the mandrel 4*c* of the developing roller 4.

Also, a toner supplying brush member 7, a toner collecting roller 11 and a toner agitating member 13 are disposed in the developing container 6.

The toner supplying brush member 7 holds a nonmagnetic toner (hereinafter referred to as the toner) T contained in a toner containing portion 6*a* which is supplied by the rotation of the toner agitating member 13, and supplies the toner T to the surface of the developing roller 4 in noncontact therewith. The surface of the toner supplying brush member 7 is disposed at an interval of 100 μm to 1 mm with respect to the developing roller 4, and the toner supplying brush member 7 is rotated in the same direction as the direction of rotation of the developing roller 4 (the opposite direction in the most proximate portion to the developing roller 4).

Figure 3:
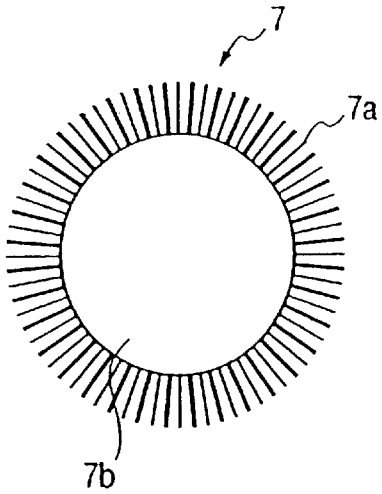
FIG. 3 is a cross-sectional view of a toner collecting roller.

The toner supplying brush member 7 is comprised of a mixed-hair brush 7*a* having elasticity as shown in FIG. 3 attached to the surface of a drum-shaped mandrel 7*b* formed of SUS or the like. In the present embodiment, a DC voltage of the negative polarity is applied from a power source 8 to the mandrel 7*b*, and the formation of a desired electric field is effected between the mandrel 7*b* and the developing roller 4.

In the present embodiment, as fiber constituting the mixed-hair brush 7*a*, use is made of two kinds of fibers, i.e., an electrically conductive fiber ($10^2$ to $10^8$ Ω·cm) having an electrical characteristic of low resistance and an insulative fiber of high resistance ($10^8$ to $10^{15}$ Ω·cm), mixed together. Fiber of a nylon property is used as the insulative fiber. This insulative fibers are not limited to nylon, but the choice of the insulative fiber can be done in conformity with a characteristic charging the toner, and for example, a material such as rayon may be used as the material for charging the toner to the negative polarity.

Figure 4:
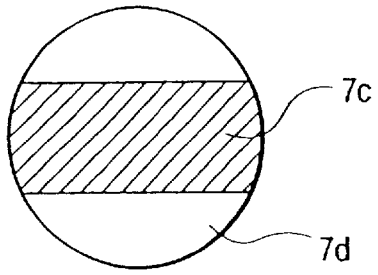
FIG. 4 is a cross-sectional view of fiber constituting the mixed-hair brush of the toner collecting roller.

On the other hand, the electrically conductive fiber may desirably satisfy the above-mentioned resistance, but in many cases, many electrically conductive fibers are formed with electrically conductive resin such as carbon dispersed in insulative fiber, and the dispersing method varies depending on fiber manufacturers, and the electrically conductive resin is not always exposed on all the surface of yarn. That is, as shown in FIG. 4, besides an electrically conducting portion 7*c*, an insulating portion 7*d* exists on the surface of the electrically conductive resin and therefore, with the contact between the toner and that portion taken into account, it is desirable to choose a material having a characteristic charging the toner to the negative polarity (a donor property) as the basis constituting material of the electrically conductive fiber, and for example, electrically conductive fiber of the nylon origin can be used.

Also, an elastic force for making the toner into a cloud is required of the fiber constituting the mixed-hair brush 7*a* and therefore, in the present embodiment, both of the electrically conductive fiber and the insulative fiber have their fineness made into the order of 1 to 10 denier/filament ($1.11\times10^{-7}$ to $1.1\times10^{-6}$ kg/m filament), and were set so that they might have implantation density of 1 to 200,000/inch$^2$ ($1.55\times10^3$ to $3.10\times10^8$/m$^2$) in a state in which they were mixed and the pile length thereof might be 1 to 10 mm.

A toner flying member 9 is disposed in such a manner as to contact with the mixed-hair brush 7*a* upstream of that region of the toner supplying brush member 7 which is most proximate and opposed to the developing roller 4. The toner flying member 9 makes the toner held by the mixed-hair brush 7*a* of the toner supplying brush member 4 into a cloud and beats and drives out the toner toward the developing roller 4.

In the present embodiment, as the toner flying member 9, use is made of a metallic thin plate having a thickness of the order of 100 $\mu$m to 1mm, and specifically a thin plate formed of SUS, phosphor bronze or the like. While a straight thin plate is used as the toner flying member 9 in the present embodiment, the shape thereof is not restricted to what has been described above, but is sometimes molded depending on the direction in which the toner is made into a cloud.

Also, with the imparting of charges to the toner interposed on the surface of contact of the toner flying member 9 with the mixed-hair brush 7*a* taken into account, resin having high charge imparting potentiality to the toner, e.g., carbon dispersed in nylon and having had its resistance adjusted to the order of $10^5$ Ω·cm may be laminated. By adopting such a construction, the imparting of charges to the toner becomes stabilized.

Also, a toner regulating blade 10 is provided so as to contact with the downstream side of that region of the developing roller 4 which is most proximate and opposed to the toner supplying brush member 7, and regulates the layer thickness of the toner made into a cloud by the toner flying member 9 and applied to the surface of the developing roller 4. In the present embodiment, the toner regulating blade 10 comprises a thin plate of stainless steel having a thickness of the order of 0.1 mm and having its fore end bent in the direction opposite to the developing roller 4 at a position of about 2 mm from that fore end portion, and the bent portion contacts with the surface of the developing roller 4 so as to eat thereinto. The contact pressure at this time is set to a line pressure of about 5 to 100 g/cm.

The toner regulating blade 10 is not restricted to the above-described metallic thin plate, but when for example, a rigid roller made of a metal is used as the developing roller 4, an elastic member formed of a rubber material such as urethane or silicon having JIS hardness of 50° to 70° may be made to abut against the developing roller with 5 to 50 g/cm to thereby regulate the thickness of the toner layer.

The toner collecting roller 11 electrostatically strips off the toner on the developing roller 4 which has not contributed to development from the surface of the developing roller 4 and returns it to the toner containing portion 6*a*. The toner collecting roller 11 is installed so as to contact with the developing roller 4 and become rotatable in the direction opposite to the direction of rotation of the developing roller 4 (the same direction in the most proximate portion). When as described above, a rigid roller is use d as the developing roller 4, the developing method becomes non-contact and the bias applied to the developing roller 4 may comprise DC superimposed on AC and therefore, in that case, it is desirable that the toner collecting roller 11 be disposed in non-contact with the developing roller 4 with a spacing of about 100 $\mu$m to 1 mm therebetween.

Also, in the present embodiment as the toner collecting roller 11, use is made of a cylindrical metallic member having its surface made into a mirror surface and electrically grounded. With the parting property of the collected toner taken into account, a fluorine resin layer such as Teflon may be laminated to a thickness of the order of 2 $\mu$m to 50 $\mu$m on the surface of the toner collecting roller 11. The lamination preventing leakage. There is also a case where in conformity with the parting property of the toner, any voltage is applied to the toner collecting roller 11.

A scraper 12 for scraping off the toner carried and collected on the surface of the toner collecting roller 11 is installed in the image forming apparatus to be in contact with the toner collecting roller 11, and the toner thus scraped off is returned to the toner containing portion 6*a*.

The toner agitating member 13 mixes and agitates the contained toner and the toner collected by the toner collecting roller 11 and the scraper 12, and supplies them to the toner supplying brush member 7 through the opening portion 14*a* of a partition wall 14.

Also, the developing roller 4 is rotated by the driving of a main motor 15, and the toner supplying brush member 7 is rotated by the driving of the main motor 15 through a driving system. The toner collecting roller 11 is rotated following the rotation of the developing roller 4. The driving of the main motor 15, the application of the developing bias by the developing bias power source 5, etc. are controlled by a control device (CPU) 18.

The operation of the above-described developing apparatus will now be described.

First, by the rotation of the toner agitating member 13, the toner T in the toner containing portion 6*a* is supplied to the toner supplying brush member 7 through the opening portion 14*a* of the partition wall 14 by a suitable amount. As the toner T, use is made, for example, of a nonmagnetic monocomponent toner having a weight average diameter of 5 $\mu$m or larger and comprising a coloring agent mixed with and dispersed in thermoplastic resin and crushed, and as the thermoplastic resin, use is made of resin of the polystyrene or polyester series (origin) containing a negative charge controlling agent.

The toner supplied to the toner supplying brush member 7 is charged (in the present embodiment, to the negative polarity) by the friction by the contact thereof with the mixed fibers of the mixed-hair brush 71. At this time, the toner is carried among the fibers and on the surface of the mixed-hair brush 7*a* by an adhering force such as a reflection force, and is carried toward the toner flying member 9 with the rotation of the toner supplying brush member 7. The toner carried to the portion of contact with the toner flying member 9 has charges more stably imparted thereto by contacting with the toner flying member 9, and passes the toner flying member 9, and thereafter is sprung out in the direction of rotation of the toner supplying brush member 7 by the elastic force of the fibers of the mixed-hair brush 7*a*, and is made into a cloud.

The toner made into a cloud and field is attracted to and carried on the surface of the developing roller 4 by an electric field formed by the developing bias applied from the developing bias power source 5 to the developing roller 4 and the bias applied from the power source 8 to the toner supplying brush member 7.

Figure 5:
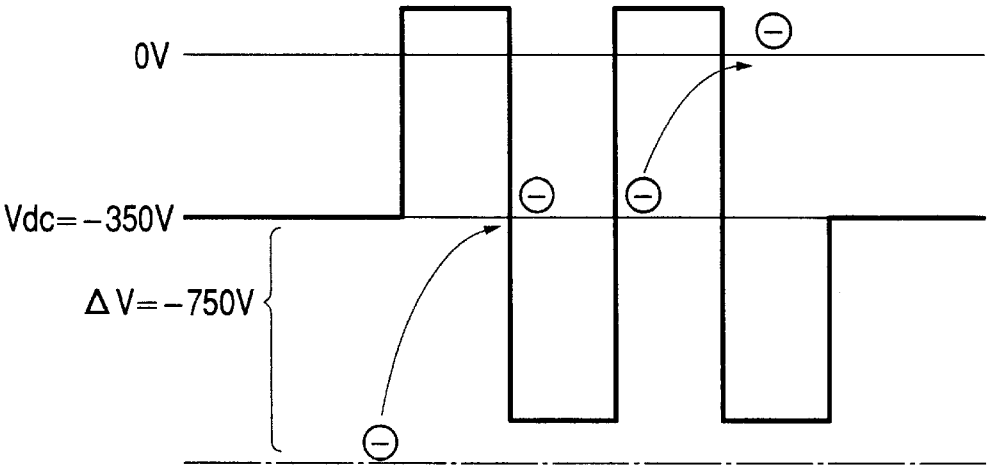
FIG. 5 shows an example of the bias application during toner supply.

When at this time, as shown, for example, in FIG. 5, the DC component of the developing bias from the developing bias power source 5 is set to Vdc=−350 V, if it is set that a DC bias of the order of ΔV=−750 V is applied to the aforementioned developing bias from the power source 8 to the toner supplying brush member 7, the toner charged to the negative polarity may fly from the toner supplying brush member 7 to the developing roller 4 by the action of the electric field by the difference in DC. Of course, the above-mentioned applied bias ΔV=−750 V changes in conformity with the spacing between the toner supplying brush member 7 and the developing roller 4.

The toner carried on the developing roller 4 is carried to the toner regulating blade 10 by the rotation of the developing roller 4, and the thinning of the toner layer and the further imparting of triboelectricity are effected by the toner regulating blade 10, and the toner is formed into a thin and dense toner layer having a uniform charging amount distribution.

On the other hand, on the photosensitive drum 1, image exposure L conforming to a desired image signal is effected from an exposing apparatus 3 and an electrostatic latent image is formed. An image-signal-processed image signal is inputted from an image signal processing portion 17 to the exposing apparatus 3.

The developing roller 4 on the surface of which the toner is carried abuts against the photosensitive drum 1 in the developing portion at a predetermined timing to thereby develops the electrostatic latent image on the photosensitive drum 1 and forms a toner image. After the formation of the toner image is completed, the developing roller 4 becomes spaced apart from the photosensitive drum 1 and is returned to its original position (home position).

The toner image formed on the photosensitive drum 1 is transferred to a transfer material (not shown) such as paper in a transferring portion, whereafter the toner image is heat-fixed on the transferring material by the heating and pressing by a fixing device (not shown) and the transferring material is discharged to the outside, thus terminating the image forming process.

On the other hand, the toner which has not contributed to development and remains carried on the developing roller 4 during the above-described formation of the toner image is electrostatically carried and collected on the surface of the toner collecting roller 11 by an electric field formed in the area of contact between the rotating toner collecting roller 11 and the developing roller 4. The toner (collected toner) carried on the surface of the toner collecting roller 11 is scraped and collected into the toner containing portion 6*a* by the scraper 12 which is in contact with the surface of the toner collecting roller 11. The toner (collected toner) collected into the toner containing portion 6*a* is mixed with the toner contained in the toner containing portion 6*a*, and is again supplied to the toner supplying brush member 7 by the rotation of the toner agitating member 13.

As described above, the charged toner is once made into a cloud and the toner is supplied onto the developing roller 4 by non-contact, whereby the mechanical stress to the toner can be remarkably reduced, and only the sufficiently charged toner is supplied onto the developing roller 4 and therefore, the inclination of the distribution of the amount of charging in the toner layer is little and this distribution becomes very sharp.

Consequently, a stable toner image of high quality can be obtained. Also, the clogging of the uncharged toner or the like residual among the fibers constituting the mixed-hair brush 7*a* can be prevented by the construction in which the toner supplying brush member 7 is brought into contact with the toner flying member 9 to thereby drive out the toner in the toner supplying brush member 7.

Also, the toner collecting roller 11 rotatable as a developer collecting member is brought into contact with the developing roller 4, whereby an always stable electric field is formed between the developing roller 4 and the toner collecting roller 11, and the toner collecting efficiency becomes high. The toner carried on the toner collecting roller 11 is reliably scraped off by the scraper 12 at each one full rotation and therefore, the accumulation of heat by continuous frictional sliding which has heretofore occurred during the formation of the toner image can be suppressed to thereby prevent the sudden deterioration of the toner.

As described above, the toner collecting mechanism by the toner collecting roller 11 is very stable but depending on the toner used, there is contained a toner which is very high in the amount of charging during the supply of the toner (e.g. a toner having a very small particle diameter), and this cannot be completely collected by a predetermined collecting bias and may be residual on the surface of the developing roller.

Such a toner is very slight in amount, but when the number of image forming sheets becomes great, the toner is accumulated little by little on the developing roller 4 and in some cases, is fused on the surface of the developing roller 4 and the edge portion of the toner regulating blade 10, and bad image formation becomes liable to occur.

So, in the present embodiment, a design is made such that before the developing of the above-described electrostatic latent image, i.e., before the developing roller 4 abuts against the photosensitive drum 1, the developing roller 4 is rotated (pre-rotation) and the developing bias is applied and further, during the operation thereof, the rotation of the toner supplying brush member 7 is once stopped so as to stop the supply of the toner from the toner supplying brush member 7.

That is, if a design is made such that the above-described operation is performed during the pre-rotation of the developing roller 4 before the developing operation, almost all of the toner residual on the developing roller 4 is collected by the toner collecting roller 11 while the developing roller 4 makes one full rotation. Further, when the developing roller 4 is intactly caused to make plural full rotations, even a toner having a very high amount of charging can be collected by the toner collecting roller 11, and it becomes possible to clean well the surface of the developing roller 4.

Of course, this operation is performed during the pre-rotation of the developing roller 4 to the last, and when the electrostatic latent image on the photosensitive drum 1 is to be developed, the toner supplying brush member 7 is rotated to thereby supply the toner to the developing roller 4.

Figure 6:
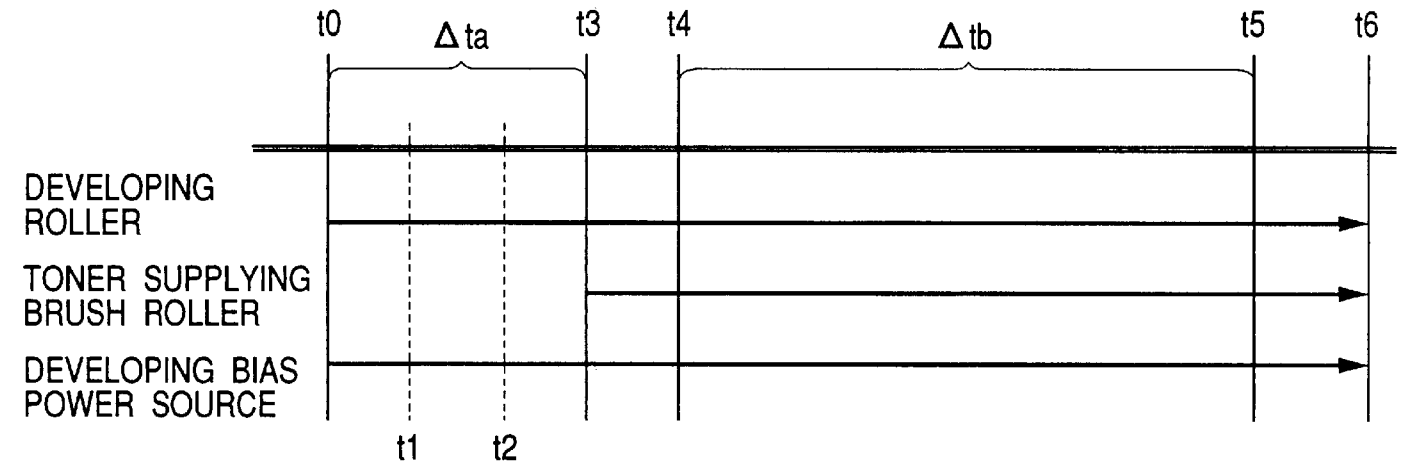
FIG. 6 shows the operation timing in the present embodiment.
Figure 7:
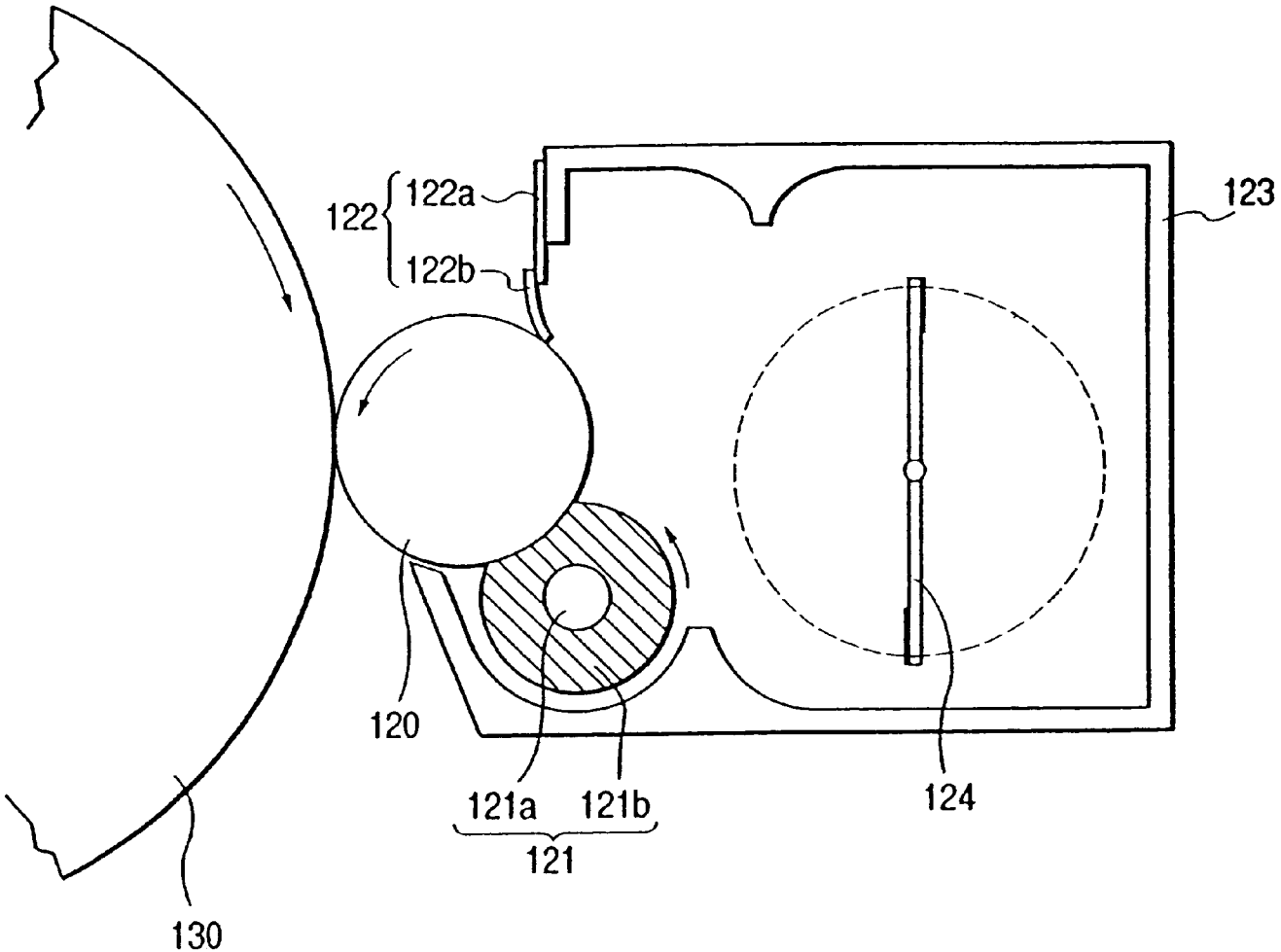
FIG. 7 PRIOR ART
FIG. 7 schematically shows the construction of an example of the developing apparatus according to the prior art.

The operation in the above-described embodiment will now be described with reference to the operation timing shown in FIG. 6.

As soon as image data is inputted to the image signal processing portion 17, the preparation for image formation (developing operation) is started at a time t0. At this time, the main motor 15 is driven by the control of the control device (CPU) 18 and the developing roller 4 starts its pre-rotation, and the developing bias power source 5 is put on and a developing bias is applied to the developing roller 4.

The toner supplying brush member 7 is stopped at the time t0, and at a time t3 after the lapse of a predetermined time Δta, the toner supplying brush member 7 starts to be rotated by the driving of the main motor 15 through the driving system 16. During this Δta, the cleaning (toner collection) of the surface of the developing roller 4 is effected by the toner collecting roller 11.

On the other hand, during this Δta, at a time t1, the surface of the photosensitive drum 1 is charged by a charger (not shown), and at a time t2, image exposure is effected by the exposing apparatus 3 to thereby forming an electrostatic latent image. At a time t4, the developing roller 4 is made to abut against the photosensitive drum 1 in accordance with the timing at which the electrostatic latent image comes to the developing portion and the development of the electrostatic latent image is started, and during Δtb till a time t5, the developing operation is terminated and a toner image is formed. After the termination of the development, at a time t6, the rotation of the developing roller 4 and the toner supplying brush member 7 is stopped and the application of the developing bias to the developing roller 4 is stopped.

As described above, in the present embodiment, even when the toner is residual on the developing roller 4, the toner is electrostatically collected by the toner collecting roller 11 and the developing roller 4 is cleaned without the toner being supplied to the developing roller 4 during the prerotation of the developing roller 4 before the developing operation is started, whereby good development becomes possible and an image of high dignity can be obtained.

Also, the above-described operation of the present embodiment is effective if it is performed during the post-rotation of the developing roller 4 after the termination of the developing operation, and is more effective if it is performed before and after the developing operation.

Also, when a great deal of image formation is to be effected, if the above-described operation is performed with the developing operation temporarily stopped at predetermined intervals, the deterioration of the developing roller and the toner regulating blade due to the fusion of the toner can be prevented even in long-term continuous image formation.

As described above, according to the present embodiment, even when the developer not used for development is residual on the developer carrying member, the developer not used for development on the developer carrying member can be collected by the collecting means for the developer not used for development before and/or after the developing operation of developing the electrostatic latent image formed on the image bearing member by the developer and therefore, the deterioration of the surface of the developer carrying member by the fusion or the like of the developer can be prevented and image formation of high quality can be accomplished, and the longer life of the developing apparatus can be achieved.

What is claimed is:

1. A developing apparatus comprising:

a developer carrying member carrying a developer thereon, said developer carrying member carrying the developer carried thereon to a developing portion, and developing a latent image formed on an image bearing member by the developer in the developing portion;

rotatable developer supplying means for supplying the developer to said developer carrying member by forming a developer supplying electric field from said developer supplying means to said developer carrying member, said developer supplying means being provided in a noncontact relationship with said developer carrying member; and developer collecting means for collecting the developer on said developer carrying member after having passed the developing portion;

wherein during a period when a developing operation is not being performed, the developer on said developer carrying member is collected by said developer collecting means with a rotation of said developer supplying means being stopped and without forming the developer supplying electric field from said developer supplying means to said developer carrying member.

2. A developing apparatus according to claim 1, wherein during the period when the developing operation is not being performed, said developer carrying member is rotated and a developing bias is applied to said developer carrying member with the supply of the developer by said developer supplying means being stopped, whereby the developer on said developer carrying member is collected by said developer collecting means.

3. A developing apparatus according to claim 1, wherein before the developing operation, the developer on said developer carrying member is collected by said developer collecting means with the supply of the developer by said developer supplying means being stopped.

4. A developing apparatus according to claim 1, wherein after the developing operation, the developer on said developer carrying member is collected by said developer collecting means with the supply of the developer by said developer supplying means being stopped.

5. A developing apparatus according to claim 1, wherein before and after the developing operation, the developer on said developer carrying member is collected by said developer collecting means with the supply of the developer by said developer supplying means being stopped.

6. A developing apparatus according to claim 1, wherein said developer supplying means has a developer supplying brush roller having a brush for carrying the developer thereon, and a developer flying member for contacting with said developer supplying brush roller, and flying the developer toward said developer carrying member.

7. A developing apparatus according to claim 6, wherein said developer supplying brush roller has a mixed-hair brush including at least two kinds of fibers differing in resistance from each other.

8. A developing apparatus according to claim 7, wherein said mixed-hair brush has at least two kinds of fibers, i.e., an electrically conductive fiber of low resistance and an insulative fiber of high resistance.

9. A developing apparatus according to claim 8, wherein said insulative fiber has a charging polarity opposite to a charging polarity of said developer, and imparts triboelectricity during the contact thereof with the developer.

10. A developing apparatus according to claim 6, wherein such a voltage that an electric field in a direction to attract the developer flown by said developer flying member to said developer carrying member is formed is applied to said developer carrying member and said developer supplying brush roller.

11. A developing apparatus according to claim 1, wherein said developer collecting means has a rotatable developer collecting roller which is in contact or proximate to said developer carrying member to which a developing bias has been applied, and electrostatically attracts said developer not used for development on said developer carrying member and carries thereon, and a developer striping member for stripping off the developer on said developer collecting roller and collecting the stripped-off developer into a developer contacting portion.

12. A developing apparatus according to claim 1, wherein said developer is a non-magnetic monocomponent developer comprising a non-magnetic toner as a chief component.

13. A developing apparatus according to claim 1, wherein during the period and when the developer on said developer carrying member is collected by said developer collecting means, an opposite direction electric field of which a direction is opposite to a direction of said developer supplying electric field is formed from said developer supplying means to said developer carrying member.

14. A developing apparatus according to claim 13, wherein when said opposite direction electric field is formed, the same voltage as that in the developing operation is applied to said developer carrying member.

15. A developing apparatus according to claim 1, wherein during the period and when the developer on said developer carrying member is collected by said developer collecting means, said developer carrying member is rotated through at least one revolution.

16. A developing apparatus according to either claim 1 or 14, wherein said developer carrying member is in contact with said image bearing member in the developing operation, while said developer carrying member is out of contact with said image bearing member during the period.

* * * * *

UNITED STATES PATENT AND TRADEMARK OFFICE

CERTIFICATE OF CORRECTION

PATENT NO. : 6,347,208 B1
DATED : February 12, 2002
INVENTOR(S) : Takeshi Yamamoto It is certified that error appears in the above-identified patent and that said Letters Patent is hereby corrected as shown below:

Column 1,
Line 22, “that” should be deleted.

Column 2,
Line 19, “toner” should read -- toner can --.

Column 4,
Line 11, “as to” should read -- as to be --; and
Line 63, “fibers are” should read -- fiber is --.

Column 6,
Line 13, “use d” should read -- used --;
Line 26, “lamination” should read -- lamination of such a resin layer plays the role of --;
Line 46, “etc.” should read -- etc., --; and
Line 65, “brush 71.” should read -- brush 7a. --.

Column 7,
Line 10, “field” should read -- flown --;
Line 44, “develops” should read -- develop --; and
Line 45, “forms” should read -- form --.

Column 8,
Line 34, “e.g.” should read -- (e.g., --; and
Line 66, “last,” should read -- last rotation, --.

Column 9,
Line 23, “forming” should read -- form --;
Line 28, “till” should read -- until --; and
Line 41, “dignity” should read -- quality --.

Column 11,
Line 7, “contact” should read -- contact with --;
Line 11, “carries” should read -- carries the developer -- and “striping” should read -- stripping --; and
Line 19, “and” should be deleted.

UNITED STATES PATENT AND TRADEMARK OFFICE

CERTIFICATE OF CORRECTION

PATENT NO. : 6,347,208 B1
DATED : February 12, 2002
INVENTOR(S) : Takeshi Yamamoto It is certified that error appears in the above-identified patent and that said Letters Patent is hereby corrected as shown below:

Column 12,
Line 10, “and” should be deleted; and
Line 18, “period..” should read -- developing operation. --.

Signed and Sealed this

Thirtieth Day of July, 2002

*Attest:*

*Attesting Officer*

JAMES E. ROGAN
*Director of the United States Patent and Trademark Office*